US011543193B2

(12) United States Patent
Stickling et al.

(10) Patent No.: US 11,543,193 B2
(45) Date of Patent: Jan. 3, 2023

(54) AIR FLOW APPARATUS INCLUDING CLEANING DEVICE FOR CLEANING AN ARRAY OF AIR CHANNELS OF THE AIR FLOW APPARATUS

(71) Applicant: Johannes Stickling, Philadelphia, PA (US)

(72) Inventors: Johannes Stickling, Philadelphia, PA (US); Matthew Mooradian, Nassau, NY (US)

(73) Assignee: Johannes Stickling, Philadelphia, PA (US)

( * ) Notice: Subject to any disclaimer, the term of this patent is extended or adjusted under 35 U.S.C. 154(b) by 0 days.

(21) Appl. No.: 17/137,113

(22) Filed: Dec. 29, 2020

(65) Prior Publication Data

US 2022/0205745 A1 Jun. 30, 2022

(51) Int. Cl.

| | |
|---|---|
| ***F28G 1/16*** | (2006.01) |
| ***F28G 15/02*** | (2006.01) |
| ***F28G 15/04*** | (2006.01) |

(52) U.S. Cl.

CPC ..... *F28G 1/166* (2013.01); *F28G 15/02* (2013.01); *F28G 15/04* (2013.01)

(58) Field of Classification Search

CPC ..... F28G 1/166; F28G 3/166; F28G 15/02; F28G 15/04; F28G 1/16

See application file for complete search history.

(56) References Cited

U.S. PATENT DOCUMENTS

| | | | | |
|---|---|---|---|---|
| 5,195,334 A * | 3/1993 | Lang | F28G 1/166 62/303 |
| 5,279,357 A * | 1/1994 | Kennon | F28G 3/166 122/391 |
| 2016/0084595 A1 | 3/2016 | Stickling et al. | |
| 2017/0160025 A1 | 6/2017 | Stickling et al. | |
| 2019/0101343 A1 | 4/2019 | Mooradian et al. | |

FOREIGN PATENT DOCUMENTS

| | | | | |
|---|---|---|---|---|
| DE | 202011001750 U1 | 3/2011 | | |
| DE | 102013007271 A1 | 12/2013 | | |
| DE | 102018004298 A1 | 4/2019 | | |
| EP | 2034266 A2 | 3/2009 | | |
| EP | 3650793 A1 * | 5/2020 | F28G 15/04 | |
| KR | 20190003873 A | 1/2019 | | |

OTHER PUBLICATIONS

EP3650793A1 English machine translation (Year: 2020).*
DE202011001750U1 English machine translation (Year: 2011).*

* cited by examiner

*Primary Examiner* — Jenna M Hopkins
(74) *Attorney, Agent, or Firm* — Richard M. Goldberg

(57) ABSTRACT

Air flow apparatus has at least one array of air channels, an air duct covering the array of air channels and being connected to the air channels, a fan arranged at the air duct for generating an air flow through the array of air channels, a cleaning device for the array of air channels arranged inside the air duct, the cleaning device including: a nozzle bar extending in front of the array of air channels and a nozzle manifold including a plurality of nozzles arranged along the nozzle bar and directed towards the array of air channels, wherein the nozzle bar is mounted to the air flow apparatus to be movable across at least a section of the array of air channels.

14 Claims, 7 Drawing Sheets

AIR FLOW APPARATUS INCLUDING CLEANING DEVICE FOR CLEANING AN ARRAY OF AIR CHANNELS OF THE AIR FLOW APPARATUS

FIELD OF THE INVENTION

The invention relates to a cleaning device for cleaning air channels or an array of air channels of an air flow apparatus. In particular, the cleaning device may be a cleaning device for cleaning air channels of a cooling array of an induced draft heat exchanger. Furthermore, the invention relates to an air flow apparatus including a cleaning device. In particular, the air flow apparatus may be an induced draft heat exchanger.

BACKGROUND OF THE INVENTION

Air flow apparatuses of the kind mentioned initially are very common in modern building infrastructure and technical applications, for example as induced draft heat exchangers for coolers for turbine bearings, for other power station components, for components of chemical plants, or for process coolers. The air flow apparatuses, which may form a generally flat, rectangular, horizontal field, include an array of air channels. These air channels are commonly formed between tubes, which may be fin tubes, i.e. tubes having fins integrally mounted or formed thereon and which may be used as cooling or heating tubes. A liquid flows through the tubes and transmits heat to or from the tubes. For example, the liquid may be a cooling liquid for transmitting heat to the cooling tubes. One or more fans may be installed above the arrays of air channels to draw air through the channels between the tubes to create a flow of ambient air along these. Thereby, for example, heat may be transferred to the ambient air, and the liquid in the tubes is cooled.

Because such air flow apparatuses are generally used outside or in dusty environments, the ambient air transports dust and dirt which accumulates on the array of air channels. Resulting heat exchange performance deficits may involve performance deficits or overheating of the apparatus, so that cleaning is required.

Air flow apparatuses may include a hood in the form of an air duct or plenum above the array of air channels to channel the air flow towards the fan(s) and/or protect the array of air channels from the environment. The hood restricts the space that is available above the array of air channels. For example, the free height may be about 80 cm or 50 cm or less. For example, an air duct may have a dimension of 2.5 m×2.5 m in horizontal directions. Furthermore, the only major openings in this hood are openings of the size of the fans. Therefore, cleaning the array of air channels is difficult. Moreover, a fan shaft may further restrict the space above the array of air channels. Due to the restricted space, manually cleaning the array of air channels is cumbersome and is hard work. Due to the restricted space above the array of air channels of an air flow apparatus whereby the array of air channels is highly enclosed by the hood, a thorough cleaning might require disassembly of at least the hood.

PRIOR ART

Automatic cleaning devices for large size open air array of air channels are described in US 2016/0084595 A1 and US 2017/0160025 A1 which describe a high-pressure cleaning apparatus for cleaning an inclined array of cooling tubes on a roof of a largescale power station. US 2019/0101343 A1 describes a cleaning apparatus with a nozzle array that is moved above the inclined heat exchanger of a power station.

SUMMARY OF THE INVENTION

It is an object of the present invention to provide a cleaning device that facilitates cleaning of an array of air channels of an air flow apparatus, in particular, cleaning of a cooling array of an induced draft heat exchanger, and that overcomes one or more of the cited problems.

A further object of the invention is to provide an air flow apparatus or, in particular, an induced draft heat exchanger, which facilitates cleaning by a cleaning device.

A further object of the invention is to provide a cleaning device for cleaning an array of air channels of an air flow apparatus, such as an induced draft heat exchanger, which cleaning device is easy to assemble and/or arrange on site.

A further object of the invention is to provide a cleaning device for cleaning an air flow apparatus or, in particular, for cleaning an induced draft heat exchanger, which simplifies the manufacturing thereof.

The invention is indicated in the independent claims. Further embodiments are indicated in the dependent claims.

To better address one or more of these objects, in a first aspect of the invention there is provided an air flow apparatus having at least one array of air channels, an air duct covering the array of air channels and being connected to the air channels, and a fan arranged at the air duct for generating an air flow through the array of air channels, wherein the air flow apparatus further includes a cleaning device for the array of air channels, arranged inside the air duct, the cleaning device comprising: a nozzle bar extending in front of the array of air channels; and a nozzle manifold including a plurality of nozzles arranged along the nozzle bar and directed towards the array of air channels, wherein the nozzle bar is mounted to the air flow apparatus to be movable across at least a section of the array of air channels. The air flow apparatus may include a heat exchanger. The air flow apparatus may comprise or be an induced draft heat exchanger. The array of air channels may be a cooling array of the induced draft heat exchanger.

Hereby, the air flow apparatus and the cleaning device are designed to arrange the cleaning device inside the air duct. The movability of the nozzle bar allows the cleaning device to be configured small enough to fit in the air duct of the air flow apparatus while allowing to clean at least a major part of the array of air channels, preferably to clean the whole array of air channels. Due to the reduced size, the cleaning device may be maintained or arranged in its working position, for example, through a small maintenance opening in the air duct covering the array of air channels, removing the need for partial deconstruction of the air flow apparatus. When the nozzle bar is moved across the section of the array of air channels, the air channels of said section may be cleaned. The nozzle manifold allows to clean a larger part of the array simultaneously, shortening the cleaning process and increasing efficiency.

For example, the fan may be arranged in the air duct. For example, the fan may be arranged centrally above the at least one array of air channels. For example, the air duct may include a hood covering the array of air channels. The hood may define a plenum above the array of air channels. For example, the cleaning device may be arranged inside the plenum or hood. For example, the air duct may be configured to convey a total air flow combining the separate air flows through the array of air channels.

For example, the nozzle bar may extend in front of a surface of the array of air channels. For example, the nozzle bar may extend in front of an array of open channel ends of the air channels of the array of air channels.

In embodiments, the cleaning device may further comprise at least one rail arranged on the array of air channels; and a trolley carrying the nozzle bar and movable along the rail in a front and rear direction of the trolley. Thus, the nozzle bar is mounted to the air flow apparatus by being mounted on the rail together with the trolley. For example, the trolley may comprise a motor and at least one driving wheel for moving the trolley along the rail. For example, the trolley may have at least one wheel and/or at least one slider that engages a bearing surface of the rail against lifting the trolley from the rail.

The rail may thereby be arranged inside the air duct of the air flow apparatus, in front of or proximate to the array of air channels. Because the trolley is configured to move on and along the rail, the rail and the trolley may be configured to be arranged above the array of air channels through a maintenance opening. The nozzle bar may extend in a transverse direction of the trolley and thus of the rail, allowing the cleaning of a defined section of the array of air channels. This further improves the cleaning process and allows to arrange the rail in a manner preventing the collision of the trolley and/or the nozzle bar with other parts of the air flow apparatus, for example the fan or a driving shaft of the fan.

When the motor is mounted to the trolley, the installation of the cleaning device on an array of air channels of an air flow apparatus is simplified; for example, the installation may require only the mounting of the rail to the air flow apparatus, while the trolley may be releasably mounted to the rail. This is particularly advantageous, since a cleaning may be scheduled between long use intervals of the air flow apparatus. For example, cleaning may be scheduled annually, or every two years. During the use interval of the air flow apparatus, the trolley preferably is not mounted to the rail. When the time comes to clean the array of air channels, the trolley including the nozzle bar can be transported to the site, the trolley can be coupled to the rail, and the nozzle bar can be installed in its position extending in a transverse direction of the trolley. The transverse direction is transverse to the front and rear direction. This also reduces accumulation of dirt on the trolley or the nozzle bar, reducing the required maintenance and improving lifetime of the cleaning device. For example, a plurality of rails may be arranged next to the array of air channels to facilitate cleaning of the whole array. The trolley may be arranged on each rail subsequently, cleaning a part of the array of air channels. Or, a plurality of trolleys and nozzle bars may be provided.

Moreover, when the motor is mounted to the trolley, driving of the trolley is simplified, as all moving parts of a trolley drive may be arranged on the trolley. A trolley drive may include the motor and the at least one driving wheel. This also allows for a compact structure of the trolley and the rail, respectively.

The motor is configured for driving the at least one driving wheel. For example, the motor may be an electric motor or a hydraulic motor.

For example, the bearing surface of the rail may be configured for bearing a load that is generated by counter-pressure of a cleaning liquid being sprayed from the nozzles towards the array of air channels.

For example, the trolley may be configured for moving on top of the rail, that is, on a top side of the rail. The trolley may be configured for moving on the rail in a front and back direction of the trolley in a working position of the trolley on the rail. For example, in the working position of the trolley on the rail, the trolley is coupled to the rail. For example, the trolley may be coupled to the rail by engaging the at least one bearing surface and/or at least one guiding surface of the rail. The at least one bearing surface and the at least one guiding surface may be or may include at least one bearing and guiding surface. For example, the cleaning device may be arranged above the array of air channels. For example, the rail, the trolley, and the nozzle bar may be arranged above the array of air channels. That is, the plurality of nozzles may be directed downwards towards the array of air channels.

For example, the nozzle bar may be detachably coupled to the trolley.

For example, the rail may comprise a metal profile, and/or the rail may comprise a hollow profile. For example, the rail may comprise or be a hollow metal profile. The profile may include the at least one bearing surface and/or at least one guiding surface.

Preferably, the nozzle bar extends to opposite sides of the trolley. This is advantageous for balancing the trolley on a single rail. For example, the cleaning device may be a monorail cleaning device. The trolley may be configured for moving on a single rail. This is advantageous since it simplifies installation of the device, and also facilitates easy movement of the trolley along the rail without getting jammed. Alternatively, the cleaning device may comprise an auxiliary rail for supporting the nozzle bar at a position remote from the first or main rail.

The nozzle bar may also be termed a nozzle beam. The nozzle bar may extend transverse to the rail or across the rail in the working position of the trolley on the rail. For example, in a working position of the trolley on the rail, the nozzle bar extends transverse to the rail. Preferably, the nozzle bar extends at a right angle to the rail.

For example, the trolley may be configured for coupling the trolley to the rail by mounting the trolley to the rail at an open end of the rail. That is, the at least one wheel and/or at least one slider that engages a bearing surface of the rail may be coupled to the rail through an open end of the rail.

For example, the at least one driving wheel may include at least one driving roller. For example, the at least one driving wheel may include a toothed wheel. For example, the rail may include a toothed rack.

The respective one of the at least one rail may extend over the at least one array of air channels in a first direction. The respective one of the at least one rail may extend along an extension of the air duct in the first direction.

In embodiments, the cleaning device comprises at least one rail in a first section of the air duct and at least one further rail in a second section of the air duct, the at least one rail and the at least one further rail being parallel to each other, wherein a rotatable member of the air flow apparatus, such as a fan shaft, is arranged between the first section and the second section of the air duct.

Thus, the at least one array of air channels may be cleaned in the first section of the air duct by the trolley moving along the at least one rail in the first section, and may be cleaned in the second section of the air duct by the trolley moving along the at least one further rail in the second section of the air duct.

For example, the rotatable member, such as a fan shaft, may be centrally arranged in the air duct. For example, a lengthwise extension of the nozzle bar in the transverse direction of the trolley may be less than an extension of the respective first and second section of the air duct transverse to the rails. Thus, the trolley carrying the nozzle bar may easily pass the rotatable member, in each of the first and second sections of the air duct.

In further embodiments, the cleaning device may comprise a fastener arranged on the nozzle bar, wherein the nozzle bar is mounted to a shaft or a rotatable member of the air flow apparatus by the fastener to be rotatable about an axis of the shaft in a direction across at least a section of the array of air channels. Thus, by rotating about the axis of the shaft, the nozzle bar is moveable across at least a section of the array of air channels. For example, the rotatable member may have a rotation axis perpendicular to a surface of the array of air channels, or perpendicular to an array of open channel ends of the air channels of the array of air channels. For example, the fastener may be arranged on one end of the nozzle bar.

By simply mounting the nozzle bar or the cleaning device to the shaft, at least a circular section of the array of air channels may be cleaned. Moreover, installation of the cleaning device is simplified. For example, the shaft or rotatable member may be a shaft of the fan, or, in particular, a driving shaft of the fan. Thus, installation is particularly simplified, when the fan shaft is present in the air flow apparatus. The shaft may be a rotatable shaft. Fastening the cleaning device to a rotatable shaft or other rotatable member of the air flow apparatus allows to clean at least a section of the array of air channels without the need of a dedicated drive of the cleaning device. This reduces complexity and manufacturing costs of the cleaning device and further reduces need for maintenance.

The nozzle bar may be arranged between the fan and the array of air channels. For example, the fan may be arranged towards an end of the air duct pointing away from the array of air channels.

The shaft or rotatable member may comprise a seat adapted to receive the fastener of the cleaning device, and the fastener may be configured to fit into the seat of the rotatable member. The cleaning device may be rotated across at least the section of the array of air channels by a rotation of the shaft or rotatable member. This rotation may be a rotation occurring during the operation of the air flow apparatus or may be a dedicated rotation for the cleaning process. The rotation speed may be below one rotation per minute.

The air flow apparatus may comprise a drive for rotating the shaft or rotatable member with the nozzle bar mounted thereon. For example, the drive may be the drive of the fan or may be a dedicated drive to rotate the rotatable member for the cleaning process.

The nozzle bar may extend perpendicular to the axis of the shaft or rotatable member.

In the following, features are described that may be present in embodiments of the cleaning device including the rail and the trolley, as well as in embodiments of the cleaning device in which the nozzle bar is mounted to a shaft or rotatable member.

In embodiments, the nozzle bar may include at least one pivotable arm. For example, some, or at least some, of the plurality of nozzles of the nozzle manifold may be arranged along the pivotable arm. The pivotable arm greatly increases the efficiency of the cleaning device, allowing for a larger configuration of the nozzle bar and may allow to subsequently increase the section of the array of air channels that may be cleaned simultaneously. The pivotable arm allows to pivot the part of the nozzle bar that is formed by the pivotable arm. The arm may, for example, pivot to avoid contact with parts of the air flow apparatus that may constrict the movement of the cleaning device across the array of air channels. The arm may, for example, pivot when in contact with parts of the air flow apparatus that may restrict the movement of the cleaning device across the array of air channels.

In an embodiment, wherein the nozzle bar is carried by the trolley, the pivotable arm of the nozzle bar may be configured to pivot when the trolley moves it across the array of air channels and the pivotable arm is in contact or comes into contact with a part of the air flow apparatus that may restrict the further movement of the pivotable arm in the direction parallel to the rail. This part may be, for example, the fan or the fan shaft of the air flow apparatus.

In an embodiment, wherein the nozzle bar is mounted to the shaft or rotatable member, the pivotable arm allows to increase the area of the array of air channels that can be cleaned. The pivotable arm allows to change the extension of the nozzle bar across the array of air channels, and thus allows for an extension of the nozzle bar that is larger than the space of the air flow apparatus which allows for an unrestricted rotation across the array of air channels. The pivotable arm is configured to pivot when it is in contact or comes into contact with a part of the air flow apparatus that may restrict the rotation of the cleaning device across the array of air channels. This part may be, for example, a side wall of the air duct.

For example, the pivotable arm may be pivotable about an angle in a plane including the front and back direction of the trolley (that is, the longitudinal direction of the rail, in a working position of the trolley on the rail) and including the direction transverse to the trolley. For example, the pivotable arm may be pivotable about an angle in a plane that is defined by the rotation of the nozzle bar. For example, the pivotable arm may be horizontally pivotable. For example, in a normal position, the pivotable arm may extend in the longitudinal direction of the nozzle bar. For example, the at least one pivotable arm may form the nozzle bar. For example, the nozzle bar may include two pivotable arms that together form a major part of the length of the nozzle bar. For example, pivotable arms may facilitate inserting the cleaning device into an air duct of the air flow apparatus, for example, through an access hatch.

In embodiments, the nozzle bar may include at least one fixed arm and the at least one pivotable arm that is hinged to the at least one fixed arm. For example, some of the plurality of nozzles of the nozzle manifold are arranged along the pivotable arm, and some of the plurality of nozzles of the nozzle manifold are arranged along the fixed arm. The connection of a pivotable arm to a fixed arm allows the nozzle bar to be configured specifically to the arrangement in and configuration of the air flow apparatus. For example, the pivotable arm may be configured to allow a fast and efficient pivoting where it is necessary, without the need to pivot the whole nozzle bar. The pivotable arm is preferably arranged at an end of the fixed arm of the nozzle bar that faces away from the trolley or the fastener of the cleaning device.

In embodiments, the at least one pivotable arm may be configured to pivot in a first pivoting direction when a guiding surface of the air flow apparatus makes contact with one end of the pivotable arm and, for example, applies a force to this end of the pivotable arm. Any part of the air flow apparatus may be configured to form the guiding surface, for example, the fan or fan shaft of the air flow apparatus, or a side wall of the air flow apparatus, such as a side wall of the air duct. The guiding surface is preferably configured to make contact with the one end of the pivotable arm when the pivotable arm is moved across the array of air channels together with the nozzle bar. The nozzle bar is then further moved by the trolley or about an axis of the shaft or the rotatable member. The guiding surface is preferably configured to be stationary, or, at least stationary with respect to its location, that is, stationary with respect to its location in the air flow apparatus; in this respect, a rotating member (or shaft) having a stationary rotation axis is understood as being stationary with respect to its location. Thus, a force is applied from the guiding surface onto the pivotable arm which subsequently pivots. The pivoting is continued at least as long as the pivotable arm makes contact with the guiding surface. The first pivoting direction may be contrary to the moving direction of the cleaning device and/or the nozzle bar.

In embodiments, the nozzle bar may comprise at least one spring configured to act against a force applied to the end of the pivotable arm. The nozzle bar may include a return spring for restoring a normal position of the at least one pivotable arm. In the normal position, the pivotable arm may extend in the transverse direction of the trolley. The at least one spring may be configured to pivot the arm in a second pivoting direction opposite of the first pivoting direction when the force of the spring is higher than the force applied to the end of the pivotable arm. The spring is preferably configured to pivot the pivotable arm back into a position identical to its position (its normal position) before making contact with a guiding surface of the air flow apparatus. This increases the efficiency of the cleaning device. Thus, the arm is configured to pivot back into a prior position which may be a position of increased extension of the arm and therefore higher efficiency of the cleaning process. The spring may be tension spring. For example, it may be a helical spring or a gas spring. The at least one pivotable arm may be configured for sliding along a fan shaft of a fan of the induced draft heat exchanger, when the trolley passes the fan shaft. For example, the at least one pivotable arm may be configured for being pivoted by being pushed against the fan shaft.

In embodiments, the guiding surface may be a surface of the air duct. The guiding surface may be an inner surface of the hood that defines the air duct. The guiding surface may be a side wall of the air duct. This allows to automatically adapt the nozzle bar to the shape of the air duct by pivoting the pivotable arm. Thus, cleaning of corner portions of a rectangular or quadratic array of air channels may be improved. The shape of the air duct usually corresponds to the shape of the array of air channels.

For example, the pivotable is arm may be configured to be pivoted by the guiding surface of the air duct when the pivotable arm moves along the surface. As soon as the cleaning device moves closer to or further away of a guiding surface of the air duct, the arm pivots away or towards the surface of the air duct. When the cleaning device moves closer to the surface of air duct, the force applied to the pivotable arm by the surface may be larger than the force applied by the spring to the pivotable arm, and the arm may pivot in the first pivoting direction, that is, away from the wall. When the cleaning device moves away from surface of the air duct, again, the force applied to the pivotable arm by the surface is lower than the force applied by the spring to the pivotable arm, and the arm pivots in the second direction towards the wall. This allows, for example, to thoroughly move the nozzle bar along a curve, corner or bulge of the air duct and thus allows for thoroughly cleaning the array of air channels. In an embodiment where the cleaning device is mounted to the shaft or rotatable member, this may allow, for example, to clean all of the area defined by the surface of the array of air channels with one rotation of the nozzle bar.

In embodiments, the pivotable arm may comprise at least one slider and/or wheel arranged on at least an end of the pivotable arm that makes contact with the guiding surface. The slider or wheel may reduce friction between the end of the pivotable arm and the guiding surface. This reduces the force required to move the cleaning device, and may prevent wear of the pivotable arm or the guiding surface.

For example, the cleaning device may include a water inlet connection for connecting a flexible hose to the nozzle manifold.

In the following, further examples of embodiments are described.

In embodiments, the rail may include a groove that is open at the top side of the rail. For example, side edges of the groove may form guiding surfaces for guiding the trolley along the rail. The side edges of the groove may face each other. The trolley may have at least one wheel and/or at least one slider that is inserted into the groove. For example, the at least one wheel and/or at least one slider may engage the side edges of the groove. For example, the at least one wheel and/or at least one slider may engage the guiding surfaces at the side edges of the groove.

In embodiments, the rail may have a hollow profile including a groove that is open at the top side of the rail, wherein inside the groove, there is formed at least one of the at least one bearing surface of the rail. The hollow profile of the rail may include a groove having an opening in a top wall of the hollow profile. For example, the opening of the groove at the top side of the rail may be arranged between a left part of a bearing surface and a right part of a bearing surface that are formed inside the groove by a top wall of the rail. The hollow profile may include a left side wall, a right side wall, and a top wall extending between the left and right side walls, the top wall being separated in two parts by the opening of the groove. Thus, for example, the bearing surface of the rail may comprise a left surface and a right surface. The opening may be arranged between the left surface and the right surface. The left side wall, right side wall, and top wall may define the groove. The hollow profile may include a bottom wall. The bottom wall may form a mounting surface for mounting the rail to an air flow apparatus.

In embodiments, the rail may include at least one bearing surface arranged on a side wing of the rail. For example, the rail may have left and right wings forming respective parts of a bearing surface at the left and right sides of the rail. For example, a left wing may form a left surface of the bearing surface, and a right wing may form a right surface of the bearing surface.

In embodiments, the bearing surface of the rail may comprise a left surface and a right surface. The opening may be arranged between the left surface and the right surface.

In embodiments, the trolley may have at least one wheel and/or at least one slider that engages a guiding surface of the rail for guiding the trolley along the rail. That is, the guiding surface of the rail is configured for guiding the trolley in the direction of the main extension of the rail. In other words, the trolley has at least one wheel and/or at least one slider that engages a guiding surface of the rail against deviating from the direction of the rail.

The guiding surface may be a bearing and guiding surface. The trolley may have at least one wheel and/or at least one slider that engages a bearing and guiding surface of the rail against lifting the trolley from the rail and for guiding the trolley along the rail. That is, at least one surface may function as the bearing surface as well as the guiding surface.

In embodiments, the trolley comprises a proximity switch for changing a moving direction of the trolley when the trolley reaches an end of a cleaning track. The end of the cleaning track may be defined by an end of the one rail of the at least one rail. The end of the cleaning track may be defined by wall of the air flow apparatus. The wall may be a wall of an air duct of the air flow apparatus. The end of the cleaning track may be defined by an end bolt or an end marking arranged at the rail. The proximity switch may be connected to the motor, or to a driving gear that connects the motor to the at least one driving wheel. The proximity switch may be at least one of an electric switch, a hydraulic switch, or a mechanic switch.

In embodiments, the trolley includes a column and a bracket that projects from the column for supporting the nozzle bar from above. For example, the trolley may include a basis, wherein the nozzle bar is arranged between the basis and the bracket. For example, the trolley may have a shape of a horizontal U. For example, the nozzle bar may be arranged across the trolley inside the U-shape. For example, the nozzle bar may cross the trolley inside the U-shape.

In embodiments, the air duct may include at least one access hatch for inserting the cleaning device into the air duct. For example, the air duct may include at least one access hatch for inserting the trolley into the air duct, wherein the access hatch is arranged at an end of the at least one rail.

In embodiments, the air duct may include a hatch door for closing the access hatch. For example, there may be one access hatch at an end of a respective rail.

In embodiments, the air flow apparatus may comprise multiple cells arranged next to each other in a first direction, each cell comprising an air duct and a fan arranged at the air duct, the air ducts covering the at least one array of air channels, the fans being arranged for generating an air flow through the at least one array of air channels, wherein the one of the at least one rail of the cleaning device extends through the cells in the first direction.

For example, at least one array of air channels may extend over more than one of the cells. Thus, a cell may comprise a part of at least one array of air channels.

For example, a cell may comprise at least one array of air channels. For example, a cell may comprise one array of air channels or multiple array of air channels.

For example, the fan and/or the shaft or rotatable member may be arranged centrally in each cell, or centrally to the air duct of each cell.

In embodiments, the air ducts of neighboring cells comprise a passage opening for letting the trolley pass from one cell to a neighboring cell, wherein the one of the at least one rail extends across the passage opening.

For example, the passage opening may be configured for letting the trolley pass, while the nozzle bar is mounted on the trolley and extends in the transverse direction of the trolley. That is, the passage opening may be configured for accommodating the entire length of the nozzle bar.

In embodiments, the air ducts comprise movable partition walls between neighboring cells arranged at the passage opening. For example, the movable partition walls may be arranged for closing the passage opening above the one of the at least one rail. Thus, during a use interval of the air flow apparatus, the passage openings may be closed by the movable partition walls. For example, the movable partition walls may be slidable or sliding partition walls.

BRIEF DESCRIPTION OF THE DRAWINGS

The present invention will become more fully understood from the detailed description of preferred embodiments given herein below and the accompanying drawings, and wherein.

DETAILED DESCRIPTION

Figure 1:
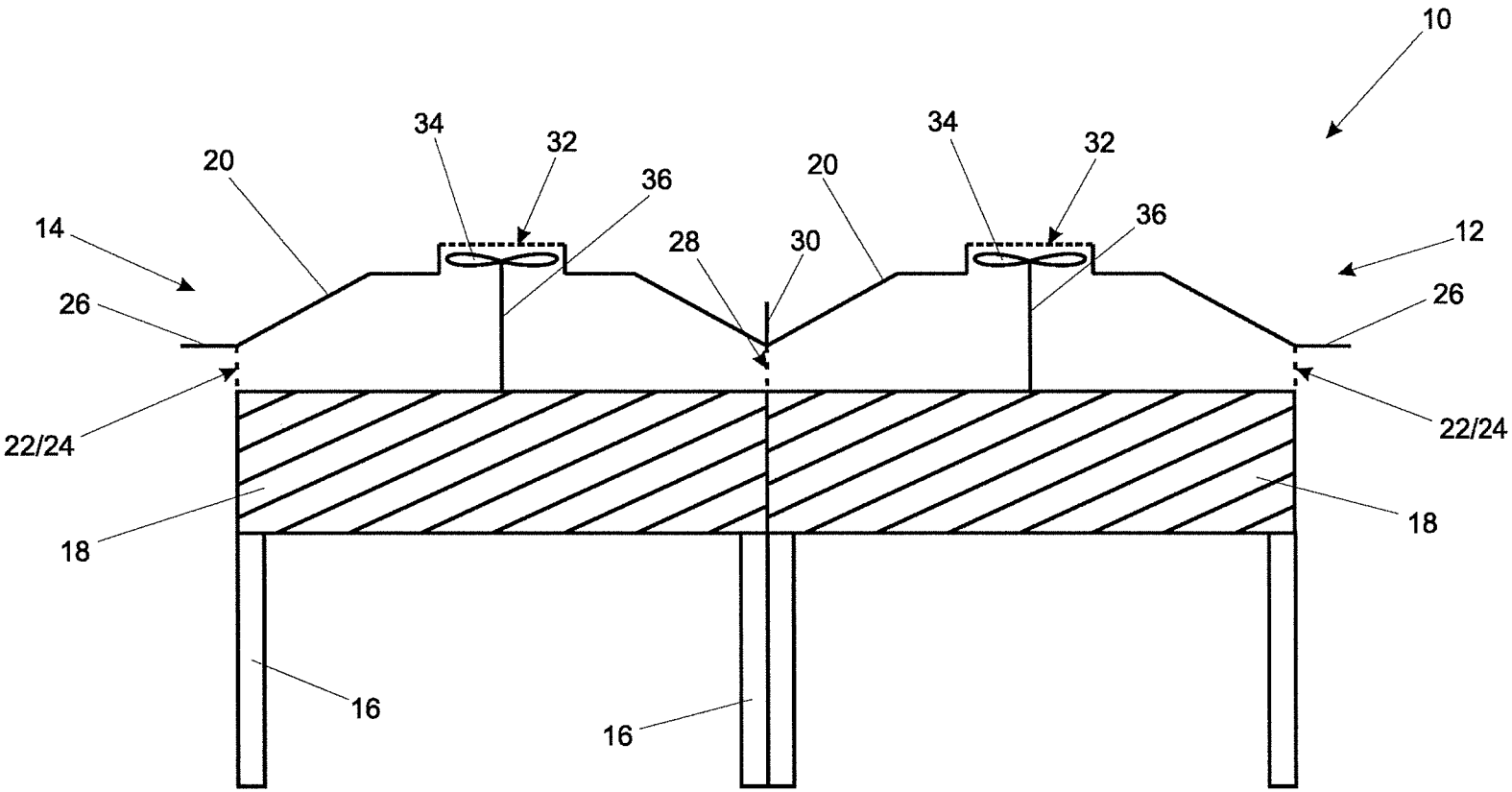
FIG. 1 is a schematic side view of an air flow apparatus.

FIG. 1 shows a side view of an air flow apparatus 10 including two identical cells 12, 14, which each include a base 16, an array of vertical air channels 18 and an air duct 20 including a hood. In the following, the setup is described exemplary for one cell 12. The cells 12, 14 each include an access hatch 22 in a side wall 24 of the air duct 20 which can be closed by a hatch door 26. However, only one cell 12, 14 may be configured to include the access hatch 22. The access hatch 22 may be arranged on the side wall 24 that is facing away from the side, on which the cells 12, 14 are connected to each other via a passage opening 28. On the connecting side, the air ducts 20 of the cells 12, 14 are divided by at least one movable partition wall 30 that separates the neighbouring cells 12, 14 and can be moved to open or close the passage opening 28. The wall 30 is configured to be pulled upwards, away from the array of air channels 18, to open the passage 28. When closed, the wall 30 ensures an efficient air flow in each cell 12, 14.

The air duct 20 has an upper opening 32 which is located next to a fan 34 and allows an airflow, which is drawn by the fan 34 from the base 16 of the air flow apparatus 10, to leave the air duct 20. The fan is driven by a fan shaft 36, extending through the air duct 20 towards the fan 34. The fan shaft 36 is perpendicular to the top surface of the array of air channels 18. The fan shaft 36 may be driven by a motor or drive, known as such.

Figure 2:
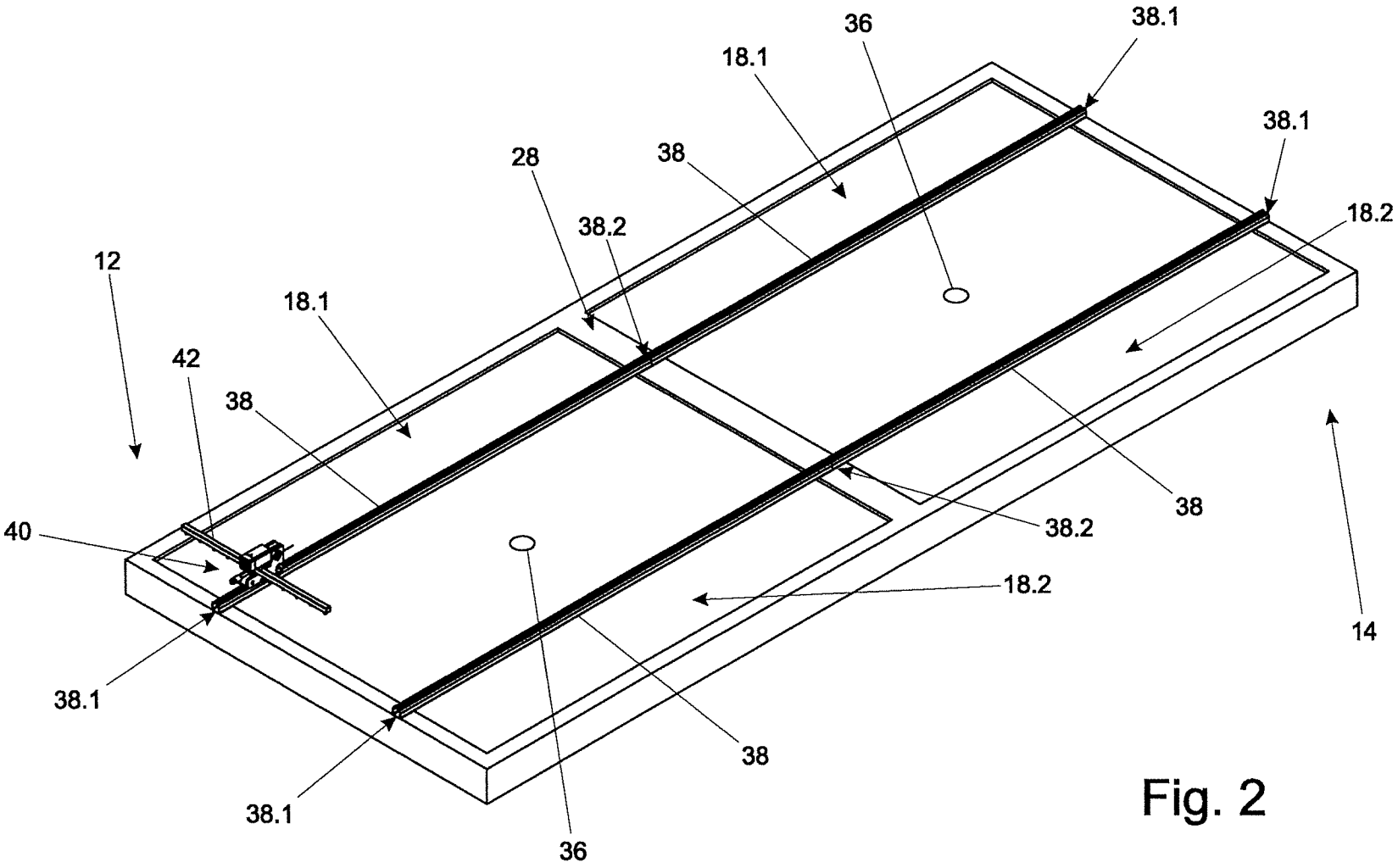
FIG. 2 is a schematic perspective view of a part of the air flow apparatus including a cleaning device, in accordance with a first embodiment.

FIG. 2 shows the air flow apparatus 10 of FIG. 1, only the array of air channels 18 being schematically shown. The array of air channels 18 includes two sections 18.1 and 18.2. Between these sections, the fan shaft 36 is arranged. In each of the sections 18.1 and 18.2, a rail 38 is arranged on top of the array of air channels 18. The rails 38 are parallel, and each rail 38 extends longitudinally in a first direction across the array of air channels 18 between the ends of the cell 12, 14. Each rail 38 is disposed in such a way that the outer end 38.1 faces the side wall 24 that includes the hatch 22 and is accessible through the respective hatch 22 (not shown). The inner ends 38.2 of the rails 38 face the passage opening 28 connecting the cells 12 and 14. The rails 38 project in such a way that the ends 38.2 of the cells 12 and 14 are adjacent to each other. The adjacent rails 38 may also be formed integrally.

FIG. 2 further shows a trolley 40, which is arranged on the rail 38 in its working position and is configured to move along the rail 38 in the first direction. The trolley 40 includes a nozzle bar 42 that extends transversely to the first direction, defining a second direction The nozzle bar 42 extends between the (in FIG. 2) upper end of the array of air channels 18 and the fan shaft 36, allowing the trolley to move along the full length of the rail 38 and clean the respective area of the array of air channels 18 that is defined by the extension of the respective section 18.1, 18.2. Furthermore, the partition wall 30 shown in FIG. 1 is configured in such a way that pulling up the wall 30 allows passage of the trolley from one cell 12, 14 into the other cell 14, 12. Because each of the rails 38 of cell 12 are adjacent to their respective counterpart in cell 14, both rails form a continuous cleaning track allowing the trolley to clean the respective sections in each of the cells 12, 14 in one movement along the continuous rail.

The trolley 40 is configured be removed from and inserted into the rail 38 and the air duct 20 through the access hatch 22 shown in FIG. 1. Preferably, each cell 12, 14 includes two access hatches 22 to access each respective rail 38. In the embodiment shown in FIG. 2, the nozzle bar 42 may be detachable from the trolley 40, or it may consist of two parts that can be pivoted to allow removal or insertion of the trolley 40 through the hatch. Also, the access hatch 22 may be configured to allow removal or insertion of the trolley 40 with a fixed nozzle bar 42.

To clean the section 18.1 of the array of air channels 18, the trolley 40 is inserted into the cell 12 and onto the (in FIG. 2) upper rail 38 at its outer end 38.1, it then is arranged in its working position as shown. Following, it moves along the rail 38 towards the passage opening 28, cleaning the section 18.1 of the array of air channels 18. The passage opening 28 may be opened pulling up by the partition wall 30 (FIG. 1) and the trolley 40 moves into the cell 14, crossing the inner ends 38.2 of the upper rail 38. At the outer end 38.1 of the rail 38 of cell 14, the trolley 40 is either removed or it moves back to cell 12. It then is removed from the air flow apparatus 10 and the process is repeated for section 18.2 of the array of air channels 18. It is thereby negligible, into which cell 12, 14 the trolley 40 is inserted into. Moreover, only one of the cells may be cleaned.

Figure 3A:
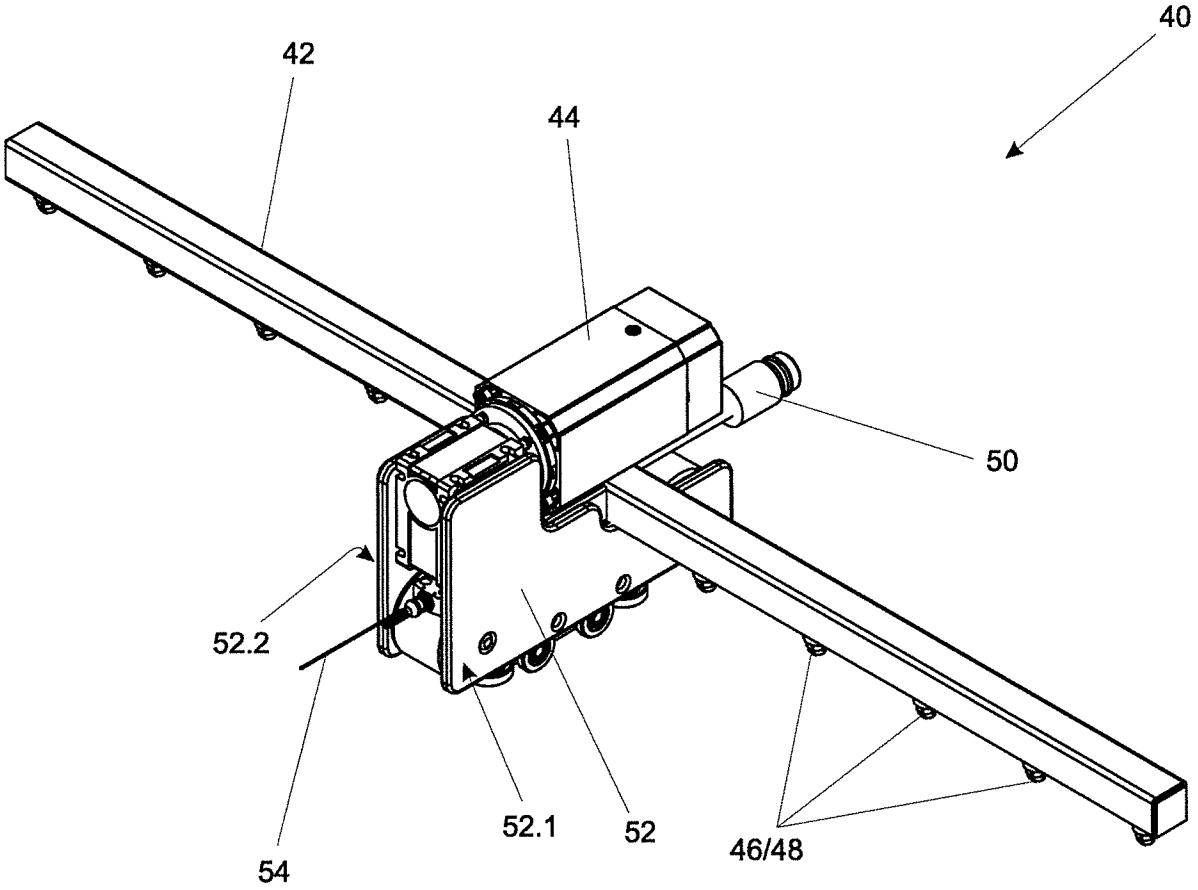
FIG. 3*a-b* are different views of a part of the cleaning device including a trolley.
Figure 3B:
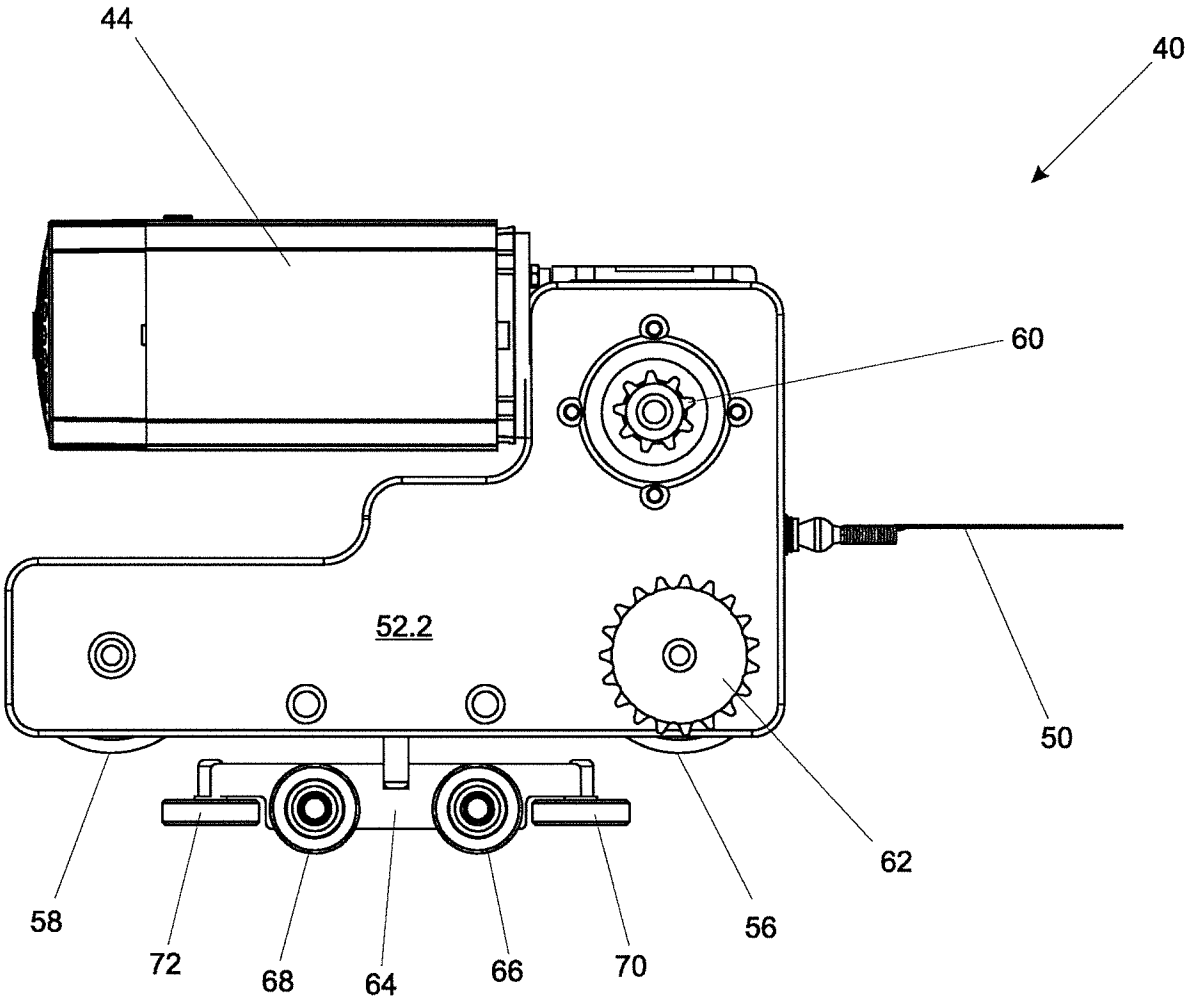

In FIGS. 3*a* and 3*b*, the trolley 40 is shown in detail. FIG. 3*a* shows a perspective of the trolley 40. The trolley 40 further includes a motor 44 for moving the trolley 40 along the rails 38 of FIG. 2. Furthermore, the trolley 40 includes the nozzle bar 42, which is arranged below the motor 44 and extends transversely to the first direction defined by the longitudinal extension of the rail, defining the second direction. The nozzle bar 42 includes a nozzle manifold 46 with a plurality of nozzles 48 arranged along the nozzle bar 42 and extending towards the array or air channels 18 (see also FIG. 3*c*). Furthermore, the nozzle bar 42 includes a connector 50 for supplying the nozzle manifold 46 with a cleaning liquid, the connector 50 extends in the first direction but is not limited thereto.

The trolley 40 further includes a L-shaped column 52 having two corresponding side parts 52.1 and 52.2. The trolley 40 further includes a proximity switch 54, arranged on one end of the trolley 40. The proximity switch extends in the first direction and is configured to be switched at a defined position on the rail 38 by moving against a closed hatch 22, for example, to change the moving direction of the trolley 40 or stop the moving of the trolley 40.

Figure 3C:
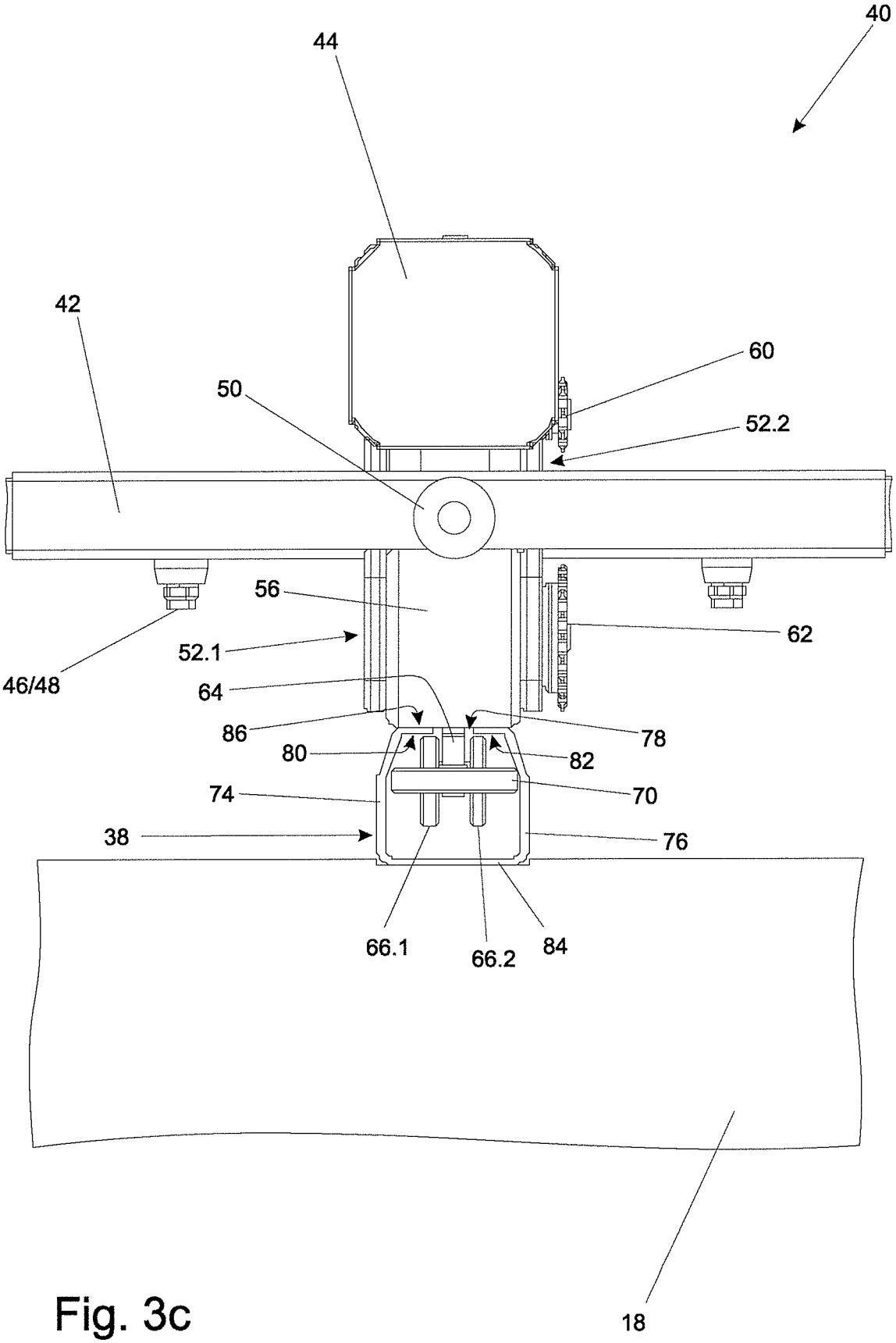
FIG. 3*c* is a side view of the cleaning device in a working position.

FIG. 3*b* shows a side view of the trolley 40. Between the bottom of the parts 52.1 and 52.2, the trolley 40 includes two wheels 56 and 58. These wheels run on top of the rail 38 as shown in FIG. 3*c* to move the trolley 40 along the rail 38. The motor power is transmitted to the driving wheel 56 by the means of gears 60, 62, which may be connected by a drive chain or another gear (not shown). Consequently, the wheel 56, which is the driving wheel, moves the trolley 40 along the rail 38.

The trolley 40 further includes a bearing part 64 extending from the in FIG. 3*b* lower part of the trolley 40 below the wheels 56, 58. The bearing part comprises bearing wheels 66, 68, 70, 72. The bearing wheels 66, 68 are arranged vertically, with their tread facing the trolley 40 and the wheels 56, 58. The bearing wheels 70, 72 are arranged horizontally.

FIG. 3*c* shows the trolley 40 in a position corresponding to FIG. 2. The trolley 40 is arranged above the array of air channels 18 and running on the rail 38. The rail 38 is shown in a cross-section and comprises two side walls 74 and 76 which form a groove that has an opening 78 at the top side of the rail 38. In their upper sections, side walls 74, 76 are tilted towards the middle of the opening, respectively. Each side wall 74,76 defines a bearing surface 80, 82 respectively. The bearing surfaces 80, 82 face the bottom wall of the rail 84 and the tread of the bearing wheels 66 and 68. The wheel 66 comprises two parts 66.1, 66.2, which bear on the bearing surface 80, 82, respectively. On top of the side walls 74,76, the side walls 74, 76 define a running surface 86 of the rail 38, on which the wheels 56 and 58 of the trolley 40 run. The treads of the bearing wheels 70, 72 face the lower vertical or tilted sections of the side walls 74,76. In case the trolley moves into the direction of the side walls 74, 76 while running on the rail 38, the bearing wheels 70, 72 bear onto the inner surface of the side walls 74,76 and ensure a smooth running on the rail 38 while keeping the trolley 40 in running orientation. To set the trolley 40 in its working position, the bearing part 64 is inserted into the rail 38 via its outer end 38.1 (see FIG. 2).

Figure 4A:
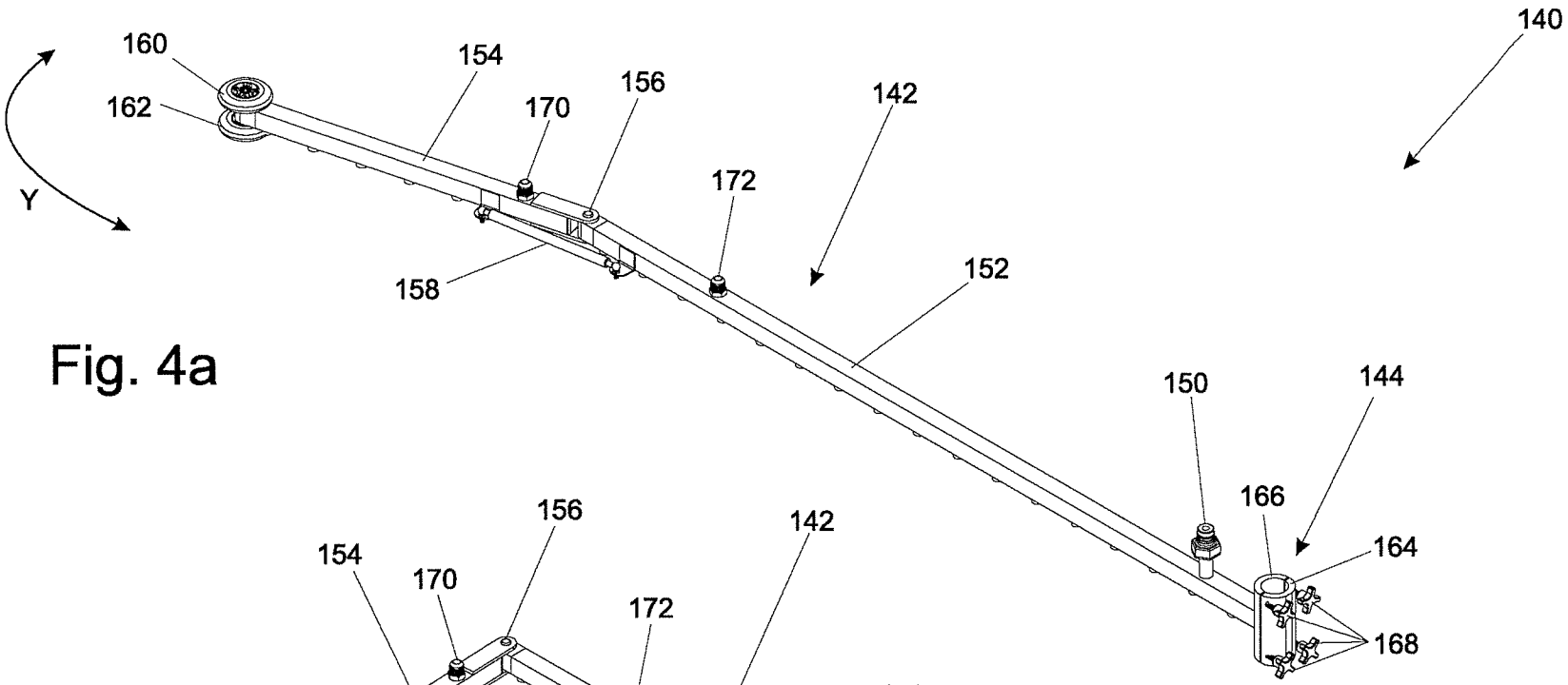
FIG. 4*a-b* are schematic views of a cleaning device in accordance with a second embodiment.
Figure 4B:
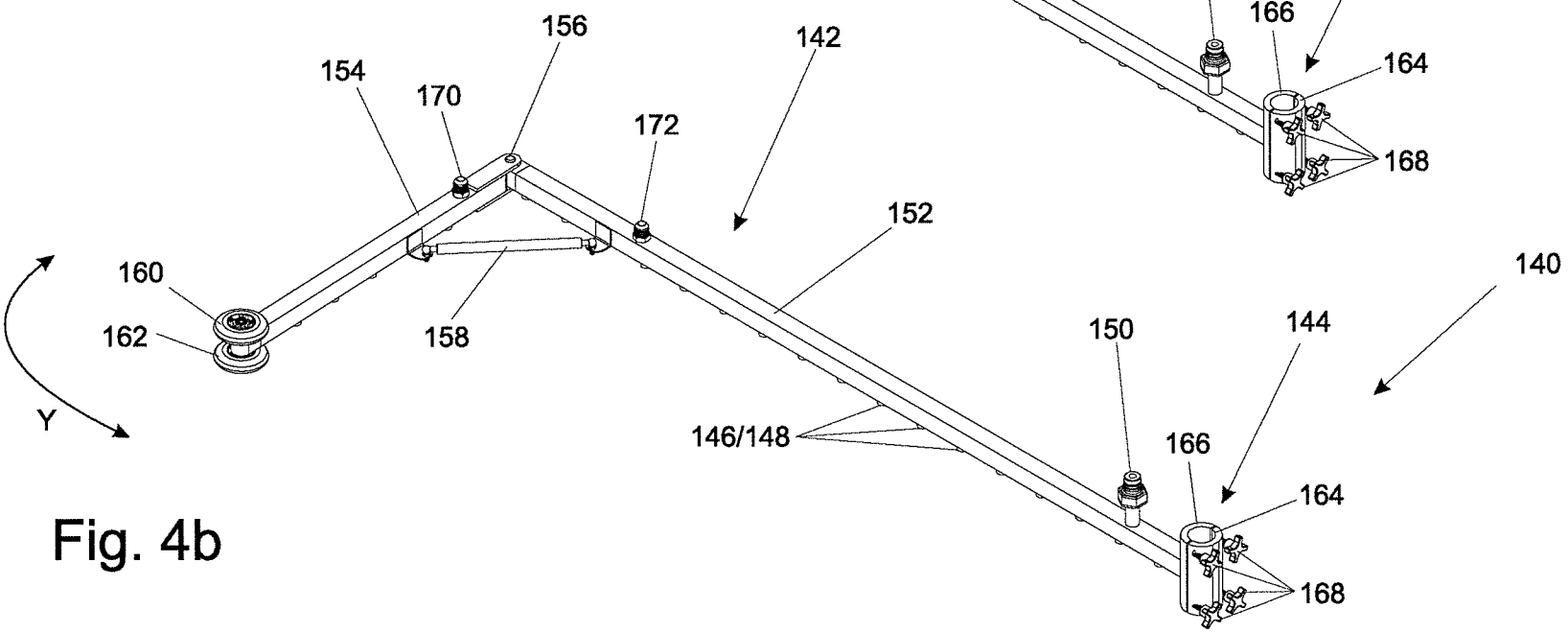

FIGS. 4*a* and 4*b* show a cleaning device 140 of another embodiment of the air flow apparatus in two different working positions. The cleaning device 140 is arranged in the air duct of the air flow apparatus of FIG. 1. The cleaning device 140 is similar to the cleaning device shown in FIG. 2-3*c* and comprises a nozzle bar 142 comprising a fastener 144 at one of its outer ends. The nozzle bar 142 comprises a nozzle manifold 146 with a plurality of nozzles 148. The nozzle bar 142 further comprises a connector 150 to connect the nozzle manifold to a supply of cleaning liquid, such as high pressure water. The nozzle bar 142 comprises two arms 152, 154. The arm 152 is fixed to the fastener 144. The arm 154 is a pivotable arm and is hinged to the arm 152 via a pivot 156. The arm 154 is configured to pivot in a horizontal plane Y. FIG. 4*a* shows the arm 154 in an extended position wherein its longitudinal axis is nearly identical to the longitudinal axis of the arm 152. The nozzle bar 142 may also be configured for identical longitudinal axes of arms 152, 154. FIG. 4*b* shows the arm 154 in a hinged position, wherein its longitudinal axis is perpendicular to the longitudinal axis of the arm 152. It goes without saying that the arm 154 may take any position in between the shown positions.

The arm 154 is also connected to the arm 152 via a spring 158. The spring 158 is configured to urge the arm 154 from the hinged position in FIG. 4*b* into the extended position in FIG. 4*a*. The arm 154 comprises two bearing wheels 160, 162 at its outer end that is facing away from the pivot 156. The bearing wheels 160, 162 are arranged horizontally, their treads facing a plane perpendicular to the plane Y.

The fastener 144 comprises two brackets 164, 166. The brackets 164, 166 face each other and form a tube or collar for receiving a tubular shape in between. The bracket 164 can be screwed to the bracket 166 by screws 168. The brackets 164, 166 are configured to fasten the cleaning device 140 to a rotatable element of the air flow apparatus, preferably the fan shaft 36 shown in FIGS. 1 and 2. Thus, a rotation of the fan shaft 36 may impart a rotation of the cleaning device in a plane perpendicular to the rotation axis of the shaft 36.

The nozzle bar 142 further comprises two arm connectors 170 and 172, located towards the ends of the arms 154, 152 that are facing each other, respectively. The arm connectors are connected by a flexible tube (not shown), connecting the respective nozzle manifolds 146 of the arms 152, 154.

Figure 5:
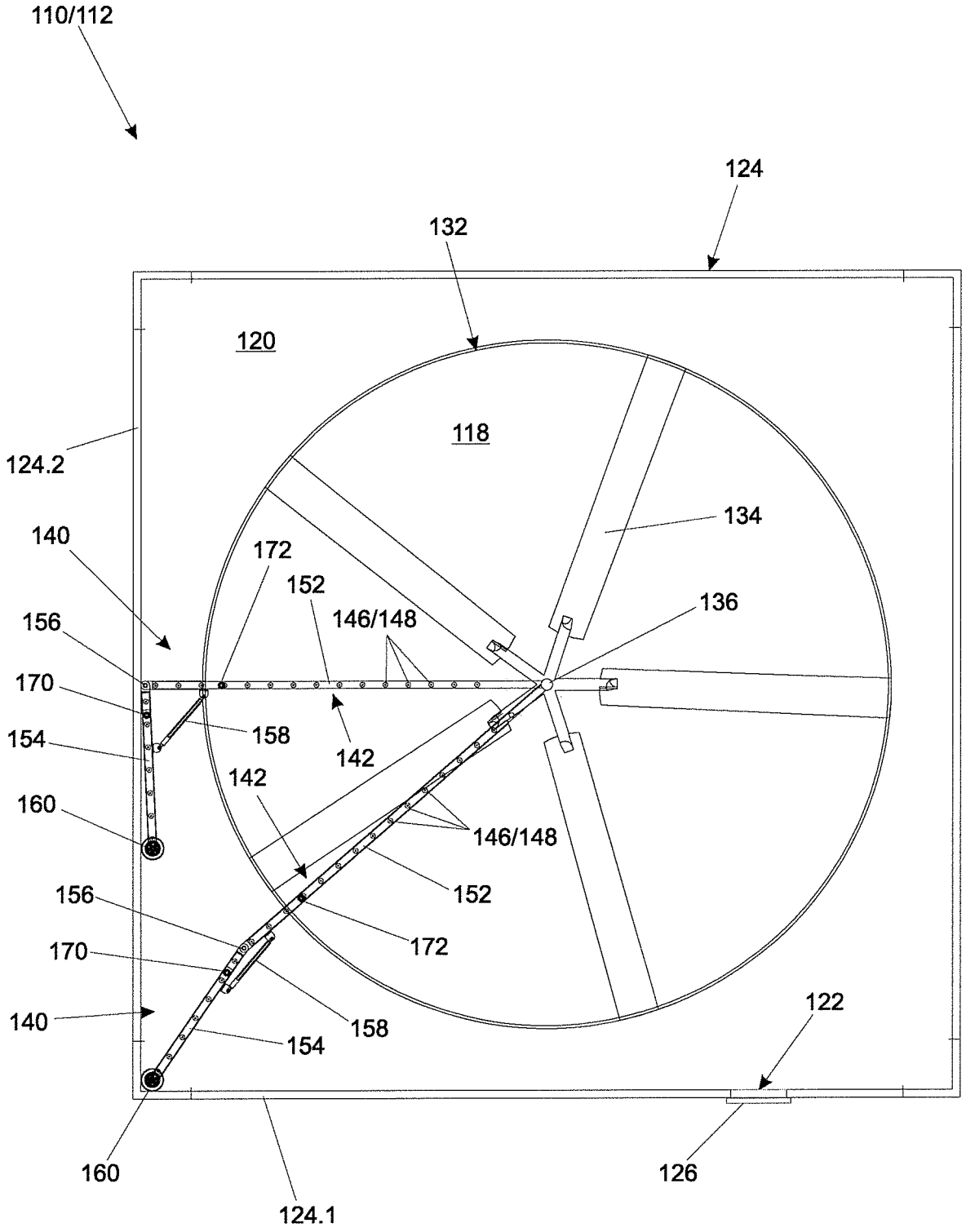
FIG. 5 is a top view of the air flow apparatus according to the second embodiment.

FIG. 5 shows the cleaning device 140 in two working positions inside the cell 112 of an air flow apparatus 110 similar to the air flow apparatus 10 of FIG. 1. The cell 112 is similar to the cell 12 of FIGS. 1 and 2. The air flow apparatus 110 may also comprise a second cell as shown in FIGS. 1 and 2. It comprises an air duct 120 with an upper opening 132. Through the opening 132, a section of an array of air channels 118 is visible, located identical to the air flow apparatus as shown in FIG. 1. At the opening 132, a fan 134 is located, mounted on and driven by a fan shaft 136. The side wall 124 of the air duct 120 also comprises an access hatch 122 covered by a hatch door 126.

The shown working positions of the cleaning device 140 correspond to the postures of the nozzle bar 142 shown in FIG. 4. The cleaning device 140 is mounted above the array of air channels 118 and below the upper opening of the air duct 132 to the fan shaft 136 by its fastener 144. A rotation of the fan shaft 136 also leads to a rotation of the cleaning device 140 above the array of air channels 118. In the embodiment shown, the fan shaft 136 and thus the cleaning device 140 rotate clockwise. In the extended working position corresponding to FIG. 4*a* (lower position in FIG. 5), the arms 152 and 154 are extended in such a way that the bearing wheels 160 and 160 make contact with the parts 124.1 and 124.2 of the side wall 124. The inner surfaces of the guide wall 124 therefore act as guiding surfaces for the pivotable arm 154.

In the extended posture, the force exerted by the walls 124.1 and 124.2 onto the arm 154 via the bearing wheels 160, 162 is lower than the opposite force exerted by the spring 158 onto the arm 154. Therefore, the arm 154 is pivoted into its extended position and the nozzle bar 142 extends into the corner of the air duct 120 formed by the walls 124.1 and 124.2. Thereby, the cleaning device 140 is also able to clean the section of the array of air channels 118 located below the corner of the air duct 120.

As soon as the fan shaft 136 and thus the cleaning device 140 rotates further clockwise, the side walls 124.2 blocks the path of the extended position of the arm 154. The force exerted onto the arm 154 by the wall 124.2 is higher than the opposite force exerted by the spring 158. Subsequently, the arm 154 pivots around the pivot 156 from its extended position into a hinged position. The spring 158 pushes the end of the arm 154 carrying the bearing wheels 160, 162 towards the side wall 124.2. The bearing wheels 160, 162 thus stay in contact with the wall 124.2 and ensure a low friction and wear between the wall 124.2 and the arm 154. This process continuous, until the arm 154 is in its maximum hinged position (upper hinged position, corresponds to FIG. 4*b*). When rotating further clockwise, the force exerted by the wall 124.2 gradually lowers and the arm 154 is pushed into a further extended position by the spring 158. When the bearing wheels 160, 162 reach the in FIG. 5 upper left corner of the air duct 120, the working position of the cleaning device 140 corresponds to the shown lower working position rotated by 90 degrees.

This embodiment allows the cleaning device 140 to clean the whole area below the air duct 120 and thus the whole area of the array of air channels 118.

The embodiments of the air flow apparatus 10, 110 and the cleaning device may be the combined as necessary. For example, the shown nozzle bar 142 may be used for the embodiment shown in FIGS. 2-3*c*.

What is claimed is:

1. An air flow apparatus comprising:

at least one array of air channels, an air duct covering the at least one array of air channels and being connected to the air channels, a fan arranged at the air duct for generating an air flow through the at least one array of air channels, and a cleaning device for the at least one array of air channels, arranged inside the air duct, the cleaning device comprising:

a nozzle bar extending in front of the at least one array of air channels, and a nozzle manifold including a plurality of nozzles arranged along the nozzle bar and directed towards the at least one array of air channels, wherein the nozzle bar is mounted to the air flow apparatus to be movable across at least a section of the at least one array of air channels, wherein the cleaning device further comprises:

at least one rail arranged on the at least one array of air channels; and a trolley carrying the nozzle bar and movable along the rail in a front and rear direction of the trolley, wherein the nozzle bar extends in a transverse direction of the trolley, wherein the trolley comprises a motor and at least one driving wheel for moving the trolley along the rail, and wherein the trolley has one of the following:

at least one wheel, at least one slider or at least one wheel and at least one slider, that engages a bearing surface of the rail against lifting the trolley from the rail, wherein the rail has a hollow profile including a groove that is open at the top side of the rail, wherein inside the groove, there is formed at least one of the at least one bearing surface of the rail.

2. An air flow apparatus comprising:

at least one array of air channels, an air duct covering the at least one array of air channels and being connected to the air channels, a fan arranged at the air duct for generating an air flow through the at least one array of air channels, and a cleaning device for the at least one array of air channels, arranged inside the air duct, the cleaning device comprising:

a nozzle bar extending in front of the at least one array of air channels, and a nozzle manifold including a plurality of nozzles arranged along the nozzle bar and directed towards the at least one array of air channels, wherein the nozzle bar is mounted to the air flow apparatus to be movable across at least a section of the at least one array of air channels, wherein the cleaning device further comprises a fastener arranged on the nozzle bar, wherein the nozzle bar is mounted to a shaft of the air flow apparatus by the fastener to be rotatable about an axis of the shaft in a direction across at least a section of the at least one array of air channels, the shaft having a rotation axis perpendicular to a surface of the array of air channels, wherein the nozzle bar includes at least one fixed arm and at least one pivotable arm that is hinged to the at least one fixed arm, wherein at least some of the plurality of nozzles of the nozzle manifold are arranged along the fixed arm, and wherein at least some of the plurality of nozzles of the nozzle manifold are arranged along the pivotable arm.

3. The air flow apparatus according to claim 2, wherein the air flow apparatus comprises a guiding surface for the at least one pivotable arm, wherein the at least one pivotable arm is configured to pivot in a first pivoting direction when the guiding surface of the air flow apparatus makes contact with one end of the pivotable arm.

4. The air flow apparatus according to claim 3, wherein the nozzle bar comprises at least one spring configured to act against a force applied to the end of the pivotable arm and to pivot the arm in a second pivoting direction opposite of the first pivoting direction when the force of the spring is higher than the force applied to the end of the pivotable arm.

5. The air flow apparatus according to claim 3, wherein the guiding surface is a surface of the air duct.

6. The air flow apparatus according to claim 2, wherein the air flow apparatus comprises a guiding surface for the at least one pivotable arm, and wherein the pivotable arm comprises one of the following:

at least one slider, at least one wheel or at least one slider and at least one wheel, arranged on at least an end of the pivotable arm that makes contact with the guiding surface.

7. The air flow apparatus according to claim 1, wherein the bearing surface of the rail comprises a left surface and a right surface.

8. The air flow apparatus according to claim 1, wherein the trolley has one of the following:

at least one wheel, at least one slider or at least one wheel and at least one slider that engages a guiding surface of the rail for guiding the trolley along the rail.

9. The air flow apparatus according to claim 1, wherein the trolley comprises a proximity switch for changing a moving direction of the trolley when the trolley reaches an end of a cleaning track.

10. The air flow apparatus according to claim 1, wherein the trolley includes a column and a bracket that projects from the column for supporting the nozzle bar from above.

11. The air flow apparatus according to claim 1, wherein the air duct includes at least one access hatch for inserting the cleaning device into the air duct.

12. The air flow apparatus according to claim 11, wherein the air duct includes a hatch door for closing the access hatch.

13. The air flow apparatus according to claim 1, wherein the air flow apparatus is an induced draft heat exchanger, and the array of air channels is a cooling array of the induced draft heat exchanger.

14. The air flow apparatus according to claim 2, wherein the air flow apparatus is an induced draft heat exchanger, and the array of air channels is a cooling array of the induced draft heat exchanger.

* * * * *